US005214236A

United States Patent [19]

Murphy et al.

[11] Patent Number: 5,214,236

[45] Date of Patent: May 25, 1993

[54] TIMING OF A MULTI-SHOT BLAST

[75] Inventors: Raymond J. Murphy, Oranjezicht; Jan Schreuder, Retreat, both of South Africa; Mark D. Chewins, Westlake; Mark Marsden, Tokai, both of Great Britain; Trevor R. Hill, Claremont, South Africa

[73] Assignee: Plessey South Africa Limited, Retreat, South Africa

[21] Appl. No.: 406,438

[22] Filed: Sep. 12, 1989

[30] Foreign Application Priority Data

Sep. 12, 1988 [ZA] South Africa ..... 88/6782

[51] Int. Cl.[5] ..... F23Q 21/00

[52] U.S. Cl. ..... 102/217; 102/215

[58] Field of Search ..... 102/217, 215, 206

[56] References Cited

U.S. PATENT DOCUMENTS

| | | | |
|---|---|---|---|
| Re. 32,888 | 3/1989 | Kirby et al. | 102/217 |
| 4,136,617 | 1/1979 | Fowler | 102/206 |
| 4,537,131 | 8/1985 | Saunders | 102/217 |
| 4,615,268 | 10/1986 | Nakano et al. | 102/217 |
| 4,632,031 | 12/1986 | Jarrott et al. | 102/206 |
| 4,674,047 | 6/1987 | Tyler et al. | 102/206 |
| 4,848,232 | 7/1989 | Kurokawa et al. | 102/206 |
| 5,014,622 | 5/1991 | Jullian | 102/215 |

FOREIGN PATENT DOCUMENTS

| | | | |
|---|---|---|---|
| 2307246 | 11/1976 | France | 102/215 |

*Primary Examiner*—Stephen M. Johnson

*Attorney, Agent, or Firm*—Merchant, Gould, Smith, Edell, Welter & Schmidt

[57] ABSTRACT

In a method of timing a multi shot blast, a plurality of explosive charges each comprising a programmable detonator arrangement 14.1 to 14.n are positioned at a blast site. At a control center 11, the desired times of the shots in the blast are programmed into a transportable firing tool 13 and the tool is carried to each detonator arrangement where a dedicated data path is established between the tool and each detonator arrangement, one after the other. The charges are fired by loading data regarding the times on which the detonator arrangements must cause their associated charges to explode into each detonator arrangement, individually. The detonator arrangements are allowed to process the data and to cause their associated charges to explode when according to a clock in the detonator arrangement and the data stored in the arrangement it is time for the charge to explode.

24 Claims, 9 Drawing Sheets

TIMING OF A MULTI-SHOT BLAST

BACKGROUND OF THE INVENTION

1. Field of the Invention

This invention relates to multiple shot blasting systems. More particularly it relates to the timing of a blast and of individual shots constituting the blast.

2. Background Information

In the known systems of the aforementioned kind, the definition of the explosion times of all shots in the blast is obtained in two distinct steps. First, the time pattern of the shots within the blast is established by installing chosen delay arrangements connecting each shot timewise to a moment i.e. the firing moment. This moment is common to all shots in the blast, but remains initially undefined and so also the explosion times remain undefined.

The second step is the definition of the common firing moment e.g. by a push of a firing button on a firing box, thereby also defining the explosion times of all the shots in the blast.

This fundamental method has remained unchanged even though delay techniques have evolved from pyrotechnical delays to the latest programmable electronic delays, and interconnections between the charges and firing box, from firing cord to electrical wire and even in some cases a radio communication path between each charge and the firing box.

It is an object of the present invention to provide an alternative method of timing the shots in a blast and also apparatus for carrying out the said method.

A close concept of time is essential to the proper understanding of the present invention and in the following specification certain terms are used as follows:

Events occur at moments. The time of a moment is the coincident reading of a clock. A moment may therefore have different times at different clocks. Instead of the time of the moment of occurrence of an event, reference may also be made to the time of an event, meaning the same thing.

Real time is the clock reading of the common standard clock society uses to define the moments of its various events.

Two clocks are synchronized if from a reading of one of the clocks the coincident reading of the other clock can be calculated.

The act of synchronizing two clocks may consist of obtaining one pair of coincident readings and the ratio of the clock pulse repetition rates of the clock pulse generators of the two clocks, alternatively, of obtaining two pairs of coincident readings separated by a long enough time interval to provide the required accuracy of synchronism.

The term "blast" is used in this specification to denote a plurality of time-related explosions. Each individual explosion in the blast may also be referred to as a shot.

The "firing" of a charge, which may also be termed the "initiating" of a charge, denotes a human act which sets in motion a causally related chain of events which may include time delays and eventually leads to the explosion of the charge.

"Explosion" and "detonation" are used as synonyms.

SUMMARY OF THE INVENTION

According to the invention there is provided a method of timing a multi-shot blast using apparatus comprising a transportable electronic firing tool including a master clock and memory and data processing circuitry; and a plurality of explosive charges, each including an electronic detonator arrangement comprising a secondary clock and memory and data processing circuitry; the firing tool and detonator arrangements being provided with means via which a dedicated data communication path can be established between the firing tool and any one selected detonator arrangement at a time, the method comprising the steps of:

preparing and positioning the charges at a blast site;

loading into and storing in the memory of the firing tool data regarding a desired time on which each charge must explode;

physically transporting the firing tool to each charge;

establishing a dedicated data path between the firing tool and each detonator arrangement individually, one after the other;

initiating the charges by loading from the tool into and storing in the memory of each detonator arrangement, when in data communication with the firing tool, time data that will cause the arrangement to detonate the charge at the desired time associated with that charge; and allowing each detonator arrangement to process the time data stored in its memory and to cause its associated charge to explode when, according to the detonator arrangement's secondary clock and the time data stored in its memory, the charge must explode.

The present invention therefore teaches a fundamentally different manner of defining the blast and shot times from which considerable advantages may be obtained. In the method according to the invention the operator controls the loading of time data to each detonator arrangement. Therefore, each charge can be initiated by the operator at a different and flexible time, while nevertheless the timing of the blast and the time pattern of the shots in the blast occur at the predetermined desired times.

Furthermore, in the known systems the common firing moment necessitates a system of external connections between the charges. The invention eliminates the need for such interconnections altogether and therefore results in a truely wireless system. Still furthermore, in underground blasting operations the whole mine section served by a common ventilation system may have to be evacuated. The blast time in the method according to the invention is independent of the operator of the firing tool and is known everywhere in the area well in advance. The method of the invention therefore provides improved safety.

The data loaded into the firing tool may be data regarding the desired time according to the master clock when each charge must explode and, upon initiating each charge, data regarding a delay time before explosion, which is equal to a difference between the said desired time and time according to the master clock of initiating the charge, is calculated and loaded into the memory of the detonator arrangement.

In the preferred embodiment, while the firing tool is in data communication with a detonator arrangement, the secondary clock of the detonator arrangement is synchronized with the master clock; and, in the step of loading and storing time data into the detonator arrangement, the master clock time at which the charge was initiated, the stored desired master clock explosion time data for the charge and secondary clock synchronization data are utilised to calculate delay time data according to the secondary clock that, when loaded into the detonator arrangement, will cause the arrangement to detonate the charge at the desired master clock time.

Also in the preferred embodiment, the firing tool master clock is synchronized with real time before the time data is loaded into the detonator arrangements.

The data regarding the desired times of the explosions may in some embodiments be loaded into the firing tool by keying it in on manual data entry means forming part of the firing tool.

However, in a preferred embodiment time data relating to the blast is prepared in a control centre using a master computer. The method therefore preferably comprises the steps of establishing a data link between the firing tool and master computer; synchronizing the master clock with a clock in the master computer; calculating master clock time data equivalent to the desired explosion times; checking the firing tool for operational integrity; and if the integrity tests are successful, loading the calculated time data into the firing tool.

Thus, in a preferred embodiment the method comprises the steps of determining the desired times of the shots in the blast in real time; entering data regarding the desired times into a master computer; synchronizing a clock in the master computer with real time; connecting the firing tool to the computer and performing an integrity test on the tool, synchronizing the master clock with the clock in the master computer and loading master clock equivalent time data of the desired times into the firing tool; when the firing tool is in data communication with a detonator arrangement, the secondary clock of the detonator arrangement is synchronized with the master clock; and using the time of initiating that charge according to the master clock, the stored desired master clock explosion time data for the charge and secondary clock synchronization data to calculate delay time data according to the secondary clock that, when loaded into the detonator arrangement, will cause the arrangement to detonate the charge at the desired master clock time.

The method may also comprise, as a safety measure, the step of delaying arming of the detonator arrangement by slowly charging an arming capacitor from a power source forming part of the detonator arrangement between the time when the charge is initiated and the desired time when the charge must explode.

When the firing tool is in data communication with a detonator arrangement and by means of programs resident in the firing tool and co-operating programs resident in the detonator arrangement, integrity tests may be performed on the detonator arrangement. The firing tool is adapted to initiate the charge if these tests are successful and not to initiate the charge if they are not successful.

To ensure that the correct time data is stored in each detonator arrangement and while the firing tool is in data communication with a detonator arrangement, a representation of the time data loaded and stored in the detonator arrangement may be returned back to the firing tool on a hand shake basis and verified by the firing tool.

For proper supervision of the charge initiating operation and/or any type of statistical analysis the method may comprise the steps of gathering, during an operation of initiating the charges, data regarding the operation and storing the data in the firing tool; reading, upon completion of the operation, the said operation data stored in the firing tool by means of the master computer; and clearing the firing tool for further use.

The delay times to be stored in the detonator arrangements normally are long compared to the delays stored in the detonators used in the known methods. To retain a high accuracy of the time pattern of the shorts in the blast in the method according to the invention, piezoelectric or magnetostrictive resonators may be used to stabilise the clock pulse generators of the detonator arrangements. With such stable resonators and with proper synchronization of the master clock and the secondary clock, the difference between the actual detonation time and the desired detonation time according to the master clock may be smaller than any one or more of 250 p.p.m., 25 p.p.m. and 1 p.p.m.

In other embodiments improved frequency stability may be obtained by irradiating the blast site with a highly stable frequency and by causing the detonator arrangements to receive this frequency and to lock their clock pulse generators to this external frequency source.

According to another aspect of the invention apparatus for programming a plurality of explosive charges to explode at predetermined desired times comprises:

a transportable electronic firing tool comprising data processing and memory circuitry, control circuitry and a master clock, the tool being programmable to receive data regarding the desired times on which the charges must explode;

an electronic detonator arrangement for each charge;

the firing tool and detonator arrangements being adapted so that a dedicated data path may be established between the firing tool and each detonator arrangement individually for the transfer of data regarding the desired time on which that detonator arrangement must detonate its associated charge; and each detonator arrangement comprising data processing and memory circuitry for storing data received, control circuitry and a secondary clock, the arrangement being adapted to detonate the charge when, according to the stored time data and its secondary clock, the charge must explode.

The firing tool may be programmed at a control station including a master computer, the firing tool being connectable to the computer via a communication link. The link may be a bidirectional serial RS 232 communications link.

The firing tool is preferably connectable to a selected detonator arrangement via an inductively coupled loop to establish the said dedicated data path between the firing tool and the selected detonator arrangement.

The firing tool may comprise a housing including a serial communications data interface connectable to the master computer; a second data interface connectable to the selected detonator arrangement, manual data entry means and a message display device all internally connected to the data processor of the firing tool.

The time data may be loaded from the master computer into the firing tool via the aforementioned communications link. In other embodiments the data may be loaded into the tool via the aforementioned manual data entry means.

In the preferred embodiment the firing tool is adapted to initiate charges by loading time data into the detonator arrangements only during a predetermined period of time after the unit has been enabled by the master computer to initiated charges. The tool may further be adapted to activate a warning indicator when the said period has expired.

The firing tool may comprise operator controllable reset means by means of which a detonator arrangement, when in data communication with the tool, may be reset to a safe condition after its associated charge has previously been initiated.

Further according to the invention each detonator arrangement preferably comprises a housing including a data interface connectable to the firing tool, an output stage and a battery all connected to the data processing and control circuitry, the output stage comprising an arming capacitor and the data processing and control circuitry being adapted to generate signals to charge the capacitor from the battery after time data is loaded to the detonator arrangement associated with the charge and to cause the capacitor to discharge into a detonating device when the detonator arrangement must detonate the explosive charge associated therewith.

The detonating device may comprise a semi-conductor bridge.

Where a number of simultaneous blasting operations take place, a number of firing tools may be programmed together and a risk therefore exist that a firing tool may be transported to a wrong blast site. To prevent an accident, each detonator arrangement may have a code stored in its memory. When the master computer loads the desired shot times of the blast into the firing tool, the codes of the detonator arrangements issued to the corresponding blast site may also be entered into the firing tool. The firing tool is adapted to initiate only detonator arrangements with the correct code. The detonator arrangement codes may be batch codes.

Thus, the detonator arrangements may be pre-programmed with a characteristic code and the firing tool may be adapted to read that code and to initiate a charge only if the unit is programmed to initiate a charge associated with that code and during the aforementioned period of time after the tool has been enabled.

Also included within the scope of the present invention is an electronic tool for initiating explosive charges each including an electronic detonator arrangement, the tool comprising a transportable housing including control circuitry; data processing and memory circuitry; means for entering data regarding desired times on which the charges must explode into the memory, a data interface connectable to a selected detonator arrangement to provide a dedicated data path between the tool and the detonator arrangement for the transfer of data regarding the time on which that detonator arrangement must detonate its associated charge; and a master clock providing the processor with master clock time data. The housing may be sealed hermetically to provide for the tool to be used under water.

The means for entering the time data into the memory arrangement of the firing tool may comprise a data interface connectable to a master computer and/or manual data entry means, such as a keyboard.

There may be provided resident programs in the firing tool and the detonator arrangements which together enable the firing tool, when in data communication with a detonator arrangement, to perform a functional integrity test on the detonator arrangement; to synchronize the secondary clock of the detonator arrangement with the master clock; to load into and store in the detonator arrangement the data regarding the time on which the detonator arrangement should detonate its associated charge; and to establish the correctness of the data stored in the detonator arrangement.

Still further included within the scope of the present invention is an electronic detonator arrangement for an explosive charge, the detonator arrangement comprising control circuitry, data processing and memory circuitry; a data interface connectable to a firing tool to provide a dedicated data path between the tool and the arrangement for the transfer of data regarding a time on which the detonator arrangement must detonate its associated charge; and a secondary clock providing the data processor with secondary clock time data; the arrangement being adapted to process the time data stored in memory and to detonate the charge, when according to the secondary clock the charge must explode.

The detonator may comprise an output stage connected to the processor and control circuitry, the output stage comprising an arming capacitor for actuating a detonating device; and a battery, the control circuitry being adapted to cause the capacitor to be charged by the battery after the charge is initiated and to cause the capacitor to discharge into the detonating device when according to the secondary clock the charge must explode.

The detonator arrangement preferably is adapted to receive and store in its memory and to process data regarding a delay time after the charge is initiated and before detonation of the charge of in excess of any one or more of 300 seconds, and 3600 seconds and In underwater applications poor visibility and limited operating time available to a diver may lead to a preferred combination of the detonating device, the said circuitry and the data interface in one housing.

BRIEF DESCRIPTION OF THE DRAWINGS

The invention will now further be described, by way of example only, with reference to the accompanying diagrams wherein.

DETAILED DESCRIPTION OF THE PREFERRED EMBODIMENTS

Figure 1:
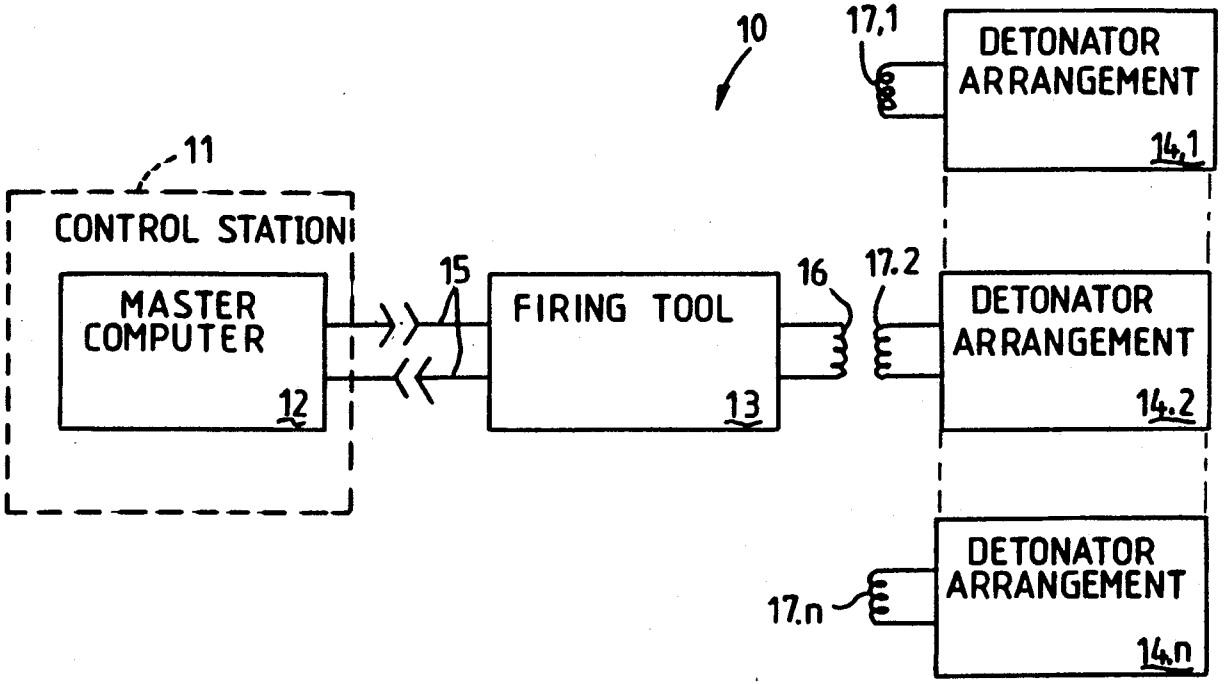
FIG. 1 is a representation in block diagram form of apparatus according to the invention for initiating a plurality of explosive charges to explode at predetermined times.

The apparatus according to the invention for initiating plurality of explosive charges to explode at predetermined times is designated generally by the reference numeral 10 in FIG. 1.

The apparatus 10 comprises a master computer 12 at a control station 11, a portable firing tool 13 and a plurality of detonator arrangements 14.1 to 14.n, each to be associated with one of the explosive charges (not shown).

In use, a control station operator enters into the master computer 12 mission control data such as the desired times of the shots in the blast (in real time). The aforementioned predetermined mission control data is transferred to firing tool 13 via a bidirectional serial RS 232 communications link 15.

Firing tool 13 comprises a data coil 16 which can be coupled inductively to a similar coil 17.1 to 17.n of a selected detonator arrangement. In this way a dedicated path is established between the firing tool 13 and only one selected detonator arrangement.

In use, the blasting site (not shown) is prepared by locating the charges comprising detonator arrangements 14.1 to 14.n in selected positions. The times on which the shots in the blast must explode are determined and the firing tool 13 is programmed by master computer 12 as outlined hereabove. Tool 13 is then carried to each detonator arrangement individually and the dedicated data path is established. Data regarding the desired time when each charge must explode is then transferred from the firing tool 13 to each detonator arrangement individually. The nature of the time data is explained in detail herebelow.

Figure 2:
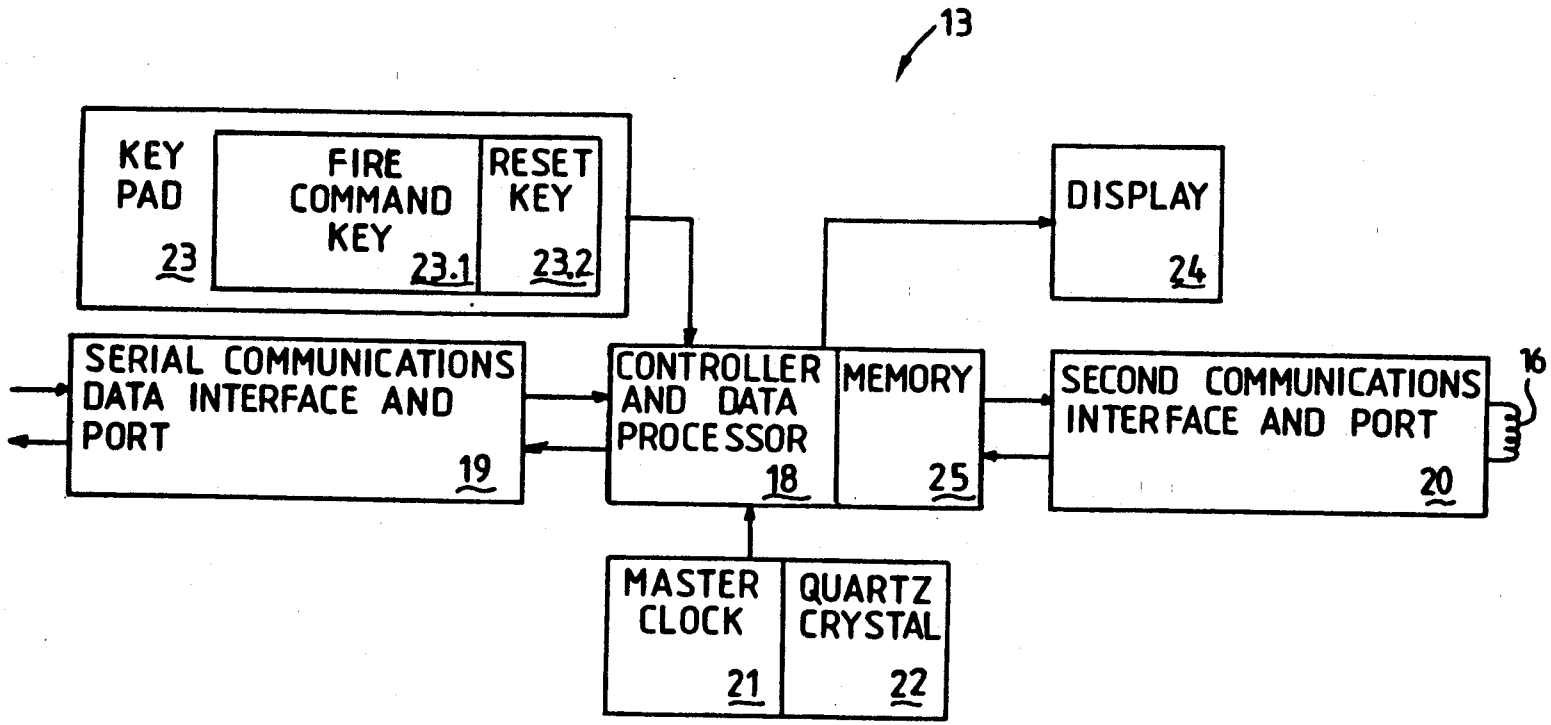
FIG. 2 is a similar representation of a portable firing tool forming part of the apparatus according to the invention.

In FIG. 2 there is shown a block diagram of the firing tool 13. The firing tool, which is a portable hand held device, comprises a housing for a controller and a data processor 18, a serial communications data interface and port 19, a second communications interface and data port 20 connected to coil 16, and a master clock 21 driven by a stable clock pulse generator stabilized by a quartz crystal oscillator 22. A key pad 23 comprising keys for inputting commands and/or time data to processor 18 as well as a message display device in the form of a liquid crystal character display 24 are connected to processor 18. The key pad 23 includes an operator controllable fire command key 23.1 and a reset key 23.2. The firing tool 13 is controlled by a program stored in memory circuitry 25 of the processor 18. The serial communications data interface and port 19 enables bidirectional communication between the master computer 12 and processor 18. The second data interface 20 enables the firing tool to communicate with a detonator 14 when the firing tool's coil 16 is coupled to the selected coil 17.1 to 17.n, of a selected detonator 14.1 to 14.n. Pulse width encoding is a preferred signal modulation technique to enable communication between the firing tool 13 and a detonator 14.

Figure 3:
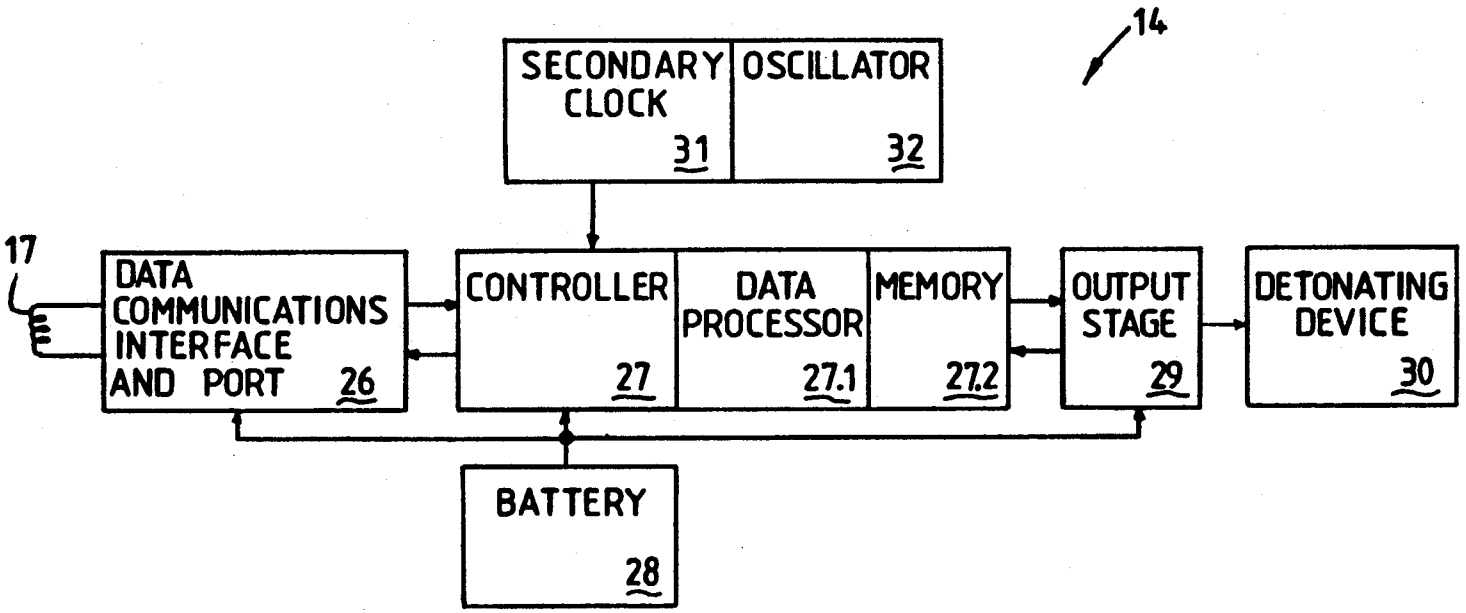
FIG. 3 is a similar representation of a programmable detonator arrangement forming part of the apparatus according to the invention.

In FIG. 3 there is shown a block diagram of a detonator arrangement. The detonator arrangement 14 comprises a housing for a data communication interface and port 26 connected to coil 17, an integrated circuit controller 27, data processor 27.1 and memory circuitry 27.2, a battery 28, an output stage 29, a detonating device 30 and a secondary clock 31 driven by a clock pulse generator stabilized by a quartz crystal oscillator 32. Data processor 27.1 receives data from interface 26 and controller 27 controls the operation of interface 26 and output stage 29.

Figure 4:
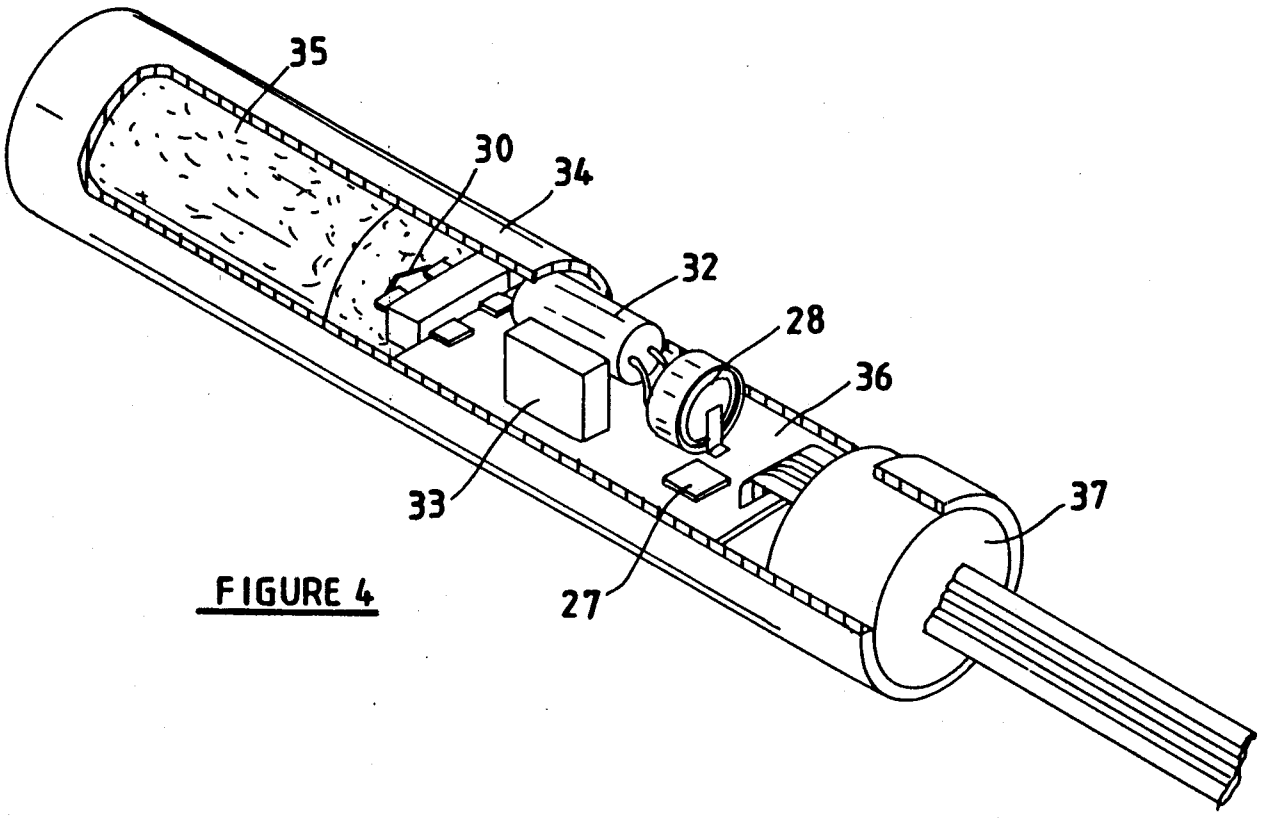
FIG. 4 is a perspective view, partially broken away, of the detonator arrangement.

In FIG. 4 there is shown a perspective view of the hereinbefore described detonator arrangement 14. detonator arrangement comprises a tubular housing 34 for a primary explosive 35. Detonating device 30 in the form of a semiconductor bridge SCB is in contact with primary explosive 35. The diagram also shows quartz crystal oscillator 32, battery 28, integrated circuit 27, 27.1 and 27.2 and capacitor 33 mounted on a board 36 in housing 34. Electrical leads to coil 17 extend through a stopper 37 for housing 34.

Figure 5:
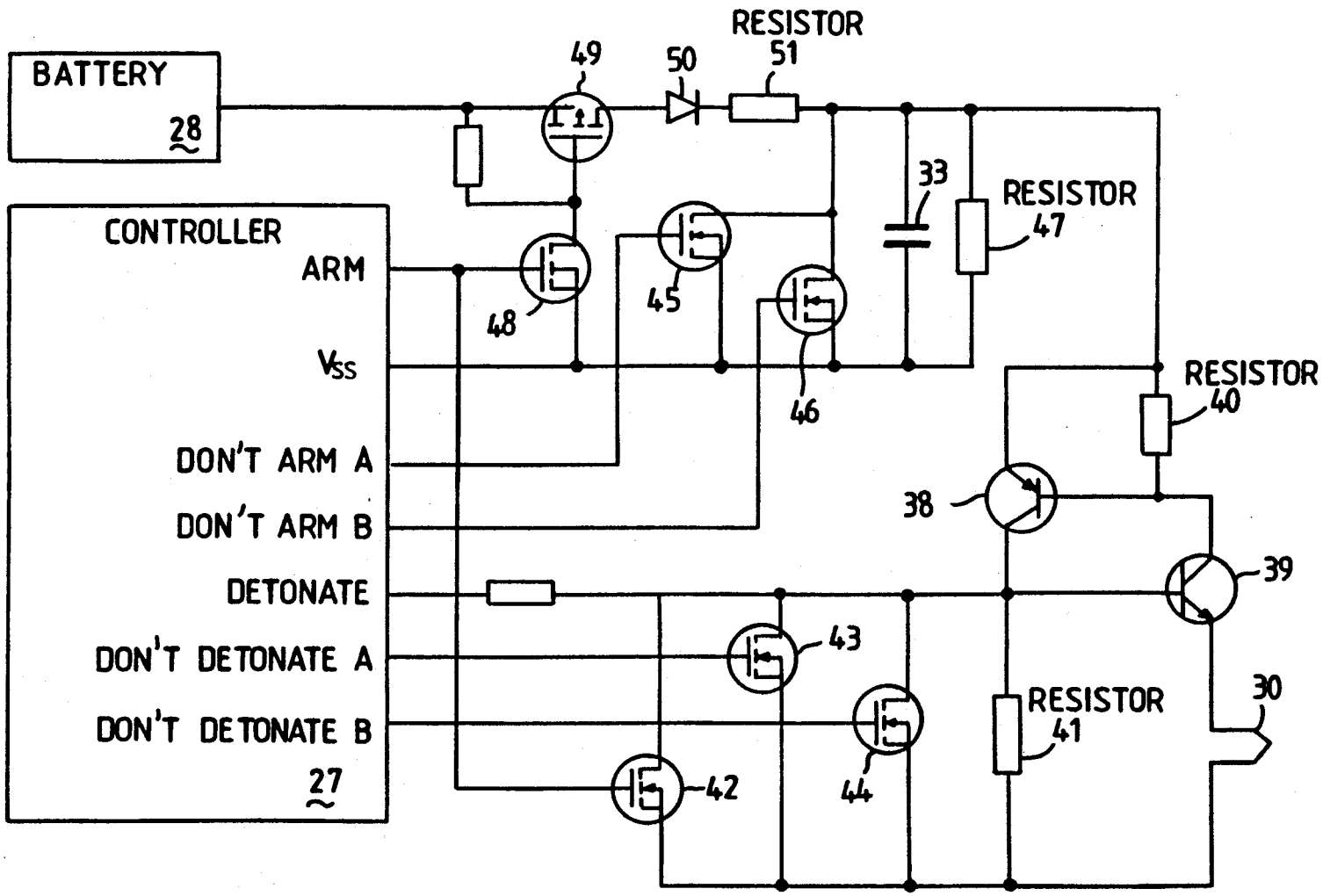
FIG. 5 is a circuit diagram of an output stage of the detonator arrangement.

The aforementioned capacitor 33 forms part of output stage 29 and its role will now be described with reference to FIGS. 5 and 6. FIG. 5 is a circuit diagram of output stage 29 and detonating device 30. As mentioned previously, capacitor 33 is charged by battery 28 and subsequently discharged into detonating device 30. Controller 27 generates the control signals for output stage 29.

Detonating device 30 is driven by bipolar junction transistor 38 and 39 which, together with resistors 40 and 41, form a latching switch. This switch is normally held off by the field effect transistors 42, 43 and 44 which are driven by the outputs of controller 27 shown in FIG. 5.

Figure 6:
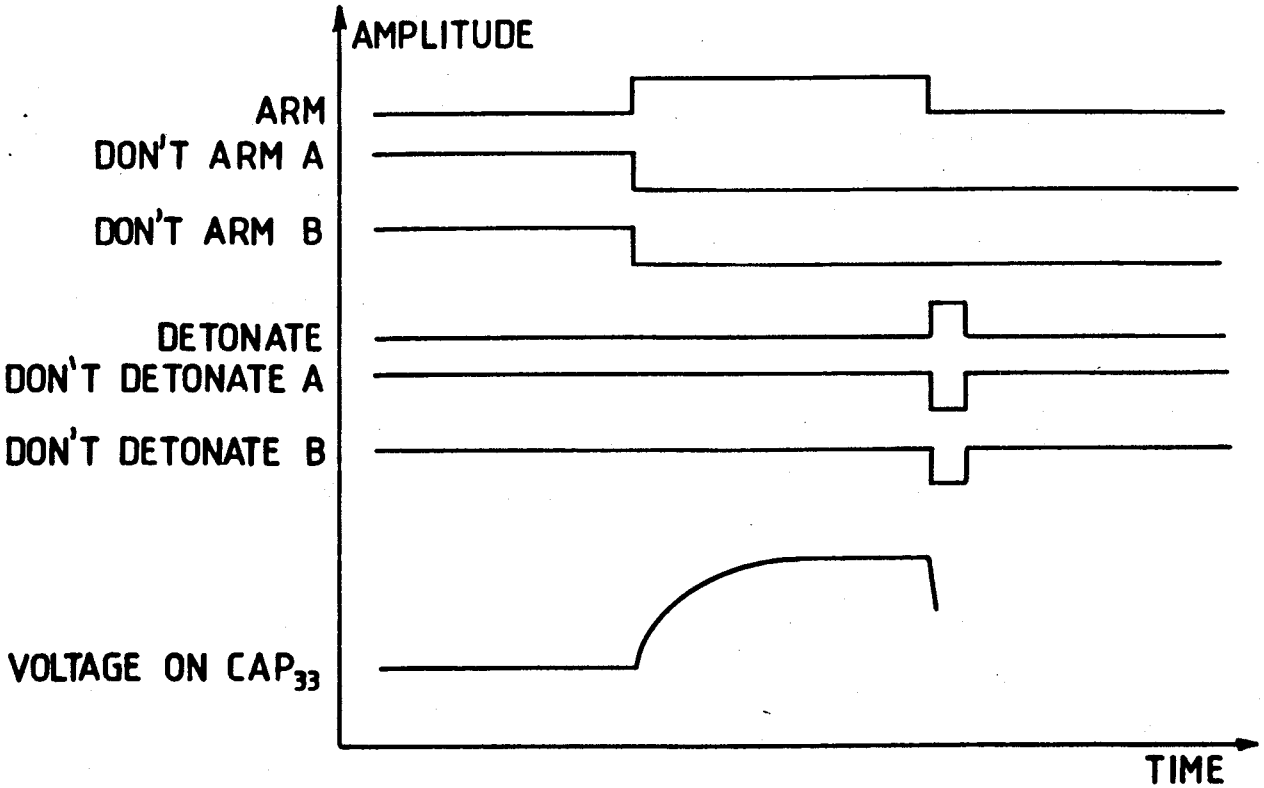
FIG. 6 is a set of waveforms of the output signals of a controller forming part of the detonator arrangement.

FIG. 6 illustrates the control signals generated by controller 27 in igniting detonating device 30. As can be seen in FIG. 6, the sequence of control signals controls the charging of arming capacitor 33 and the discharging of capacitor 33 across semi-conductor bridge 30 to ignite the bridge causing the explosive charge to explode.

As mentioned previously, the latching switch formed by bipolar junction transistors 38 and 39 and resistors 40 and 41 is normally held off by field effect transistors 42, 43 and 44, which are driven by three outputs of controller 27 ("DETONATE", "DON'T DETONATE A" and "DON'T DETONATE B", respectively). Field effect transistors 45 and 46, controlled by "DON'T ARM A" and "DON'T ARM B", respectively, normally provide low impedance paths across the aforementioned arming capacitor 33 to prevent an electric charge from accumulating until required. Resistor 47 provides a leakage path to discharge the capacitor 33 even when the circuit is not switched on.

As shown in FIG. 6, when the charge is initiated, the "ARM" signal goes high and the "DON'T ARM A" and "DON'T ARM B" signals go low. This causes transistor 48 to conduct which in turn causes transistor 49 to conduct. Current is then supplied from transistor 49 to the arming capacitor 33 via diode 50 and resistor 51. The voltage on the capacitor 33 then builds up as shown in FIG. 6. At the moment of detonation, the "ARM", "DON'T DETONATE A" and "DON'T DETONATE B" signals go low. The "DETONATE" signal goes high and turns on the aforementioned latching switch, which in turn allows the charge stored on arming capacitor 33 to be dumped into the semi-conductor bridge 30 to ignite the bridge, causing the explosive charge to explode.

FIGS. *7a* and *7b* show three flow charts of a preferred implementation of the controller and processor 18 of the firing tool 13. Main routine 70 shown in FIG. *7a* controls the time sequential behaviour of the tool. Timer interrupt service routine 71, shown in FIG. *7b*, is called periodically to update the master clock 21 and interrupts the main routine 70 irrespective of where in the main routine the processor is. This interrupt is generated by the processor's hardware. Similarly an interrupt is generated when serial communications takes place and the serial communications interrupt service routine 72 is called to process data received from the master computer 12.

Special attention is drawn to box 73 in FIG. *7a* with the question "Time window expired"? This relates to a safety feature in terms of which a time window or time period for firing charges is established in firing tool 13 by master computer 12 by enabling the tool. The firing tool is adapted to initiate charges by loading time data into the detonator arrangements only during the predetermined period of time after the tool has been enabled by the master computer to initiate the charges. The tool may be further adapted to activate a warning indicator when the said period has expired.

Master computer 12 is used to enter desired blast times for later loading to detonator arrangements 14. The master computer 12 also synchronizes the master clock in firing tool 13 and maintains a data base in which data relating to the shot times and blasting activities for each firing tool are recorded for management and control purposes.

At the start of a charge initiating operation the firing tool operator couples his tool 13 to the master computer 12. As shown by serial communications subroutine 72 in FIG. 7*b*, the master computer then interrogates the tool 13 and reads an identification code to obtain its identity and to ascertain if its integrity test routines have detected any faults. If no faults have been detected, then the master computer 12 sends the aforementioned mission control data to the firing tool which stores it in memory at 74. The real time data enables the firing tool to synchronize the master clock 21 with real time. The firing tool 13 acknowledges receipt of the data by sending at 75 a representation of the data received and stored in its memory back to the master computer 12. The master computer can thus verify the integrity of the transmission and then sends a response to be verified by the tool, as shown by block 76. This handshake and verification technique, whereby each message has a correct response that must be sent in reply, is employed in most of the communication loops in the system. Once the master computer 12 has established that the firing tool 13 has been correctly programmed and the mission control data is stored in memory, a command 77 is sent to the firing tool which enables it to initiate charges during the aforementioned time window.

Once enabled by the master computer 12 the firing tool 13 is ready to initiate explosive charges by loading into each detonator arrangement 14.1 to 14.n data regarding the predetermined desired explosion time of that charge. This is achieved by the firing tool operator physically coupling the data coil 16 of the firing tool to the coil 17 of the detonator arrangement associated with the charge to be initiated. By pressing the fire command key 23.1 on the firing tool, the time data, the nature of which is to be explained herebelow, is loaded into the selected detonator arrangement. If the time of connection between tool 13 and detonator arrangement 14 is within the aforementioned time window, then a series of messages are exchanged on a handshake basis between the firing tool 13 and the detonator arrangement.

Figure 7A:
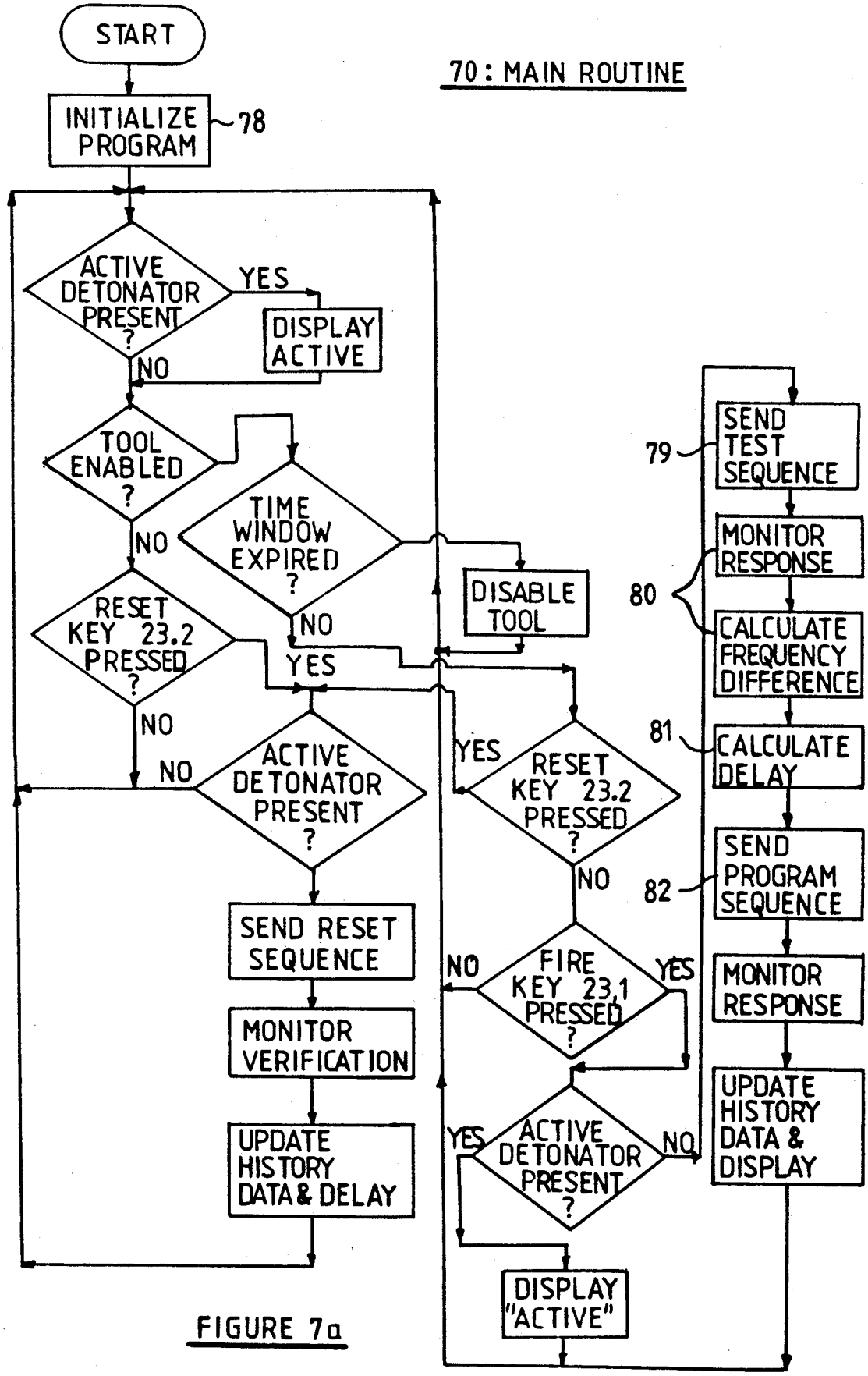
FIGS. 7*a* and *b* are flow charts illustrating the operation of the firing tool.
Figure 7B:
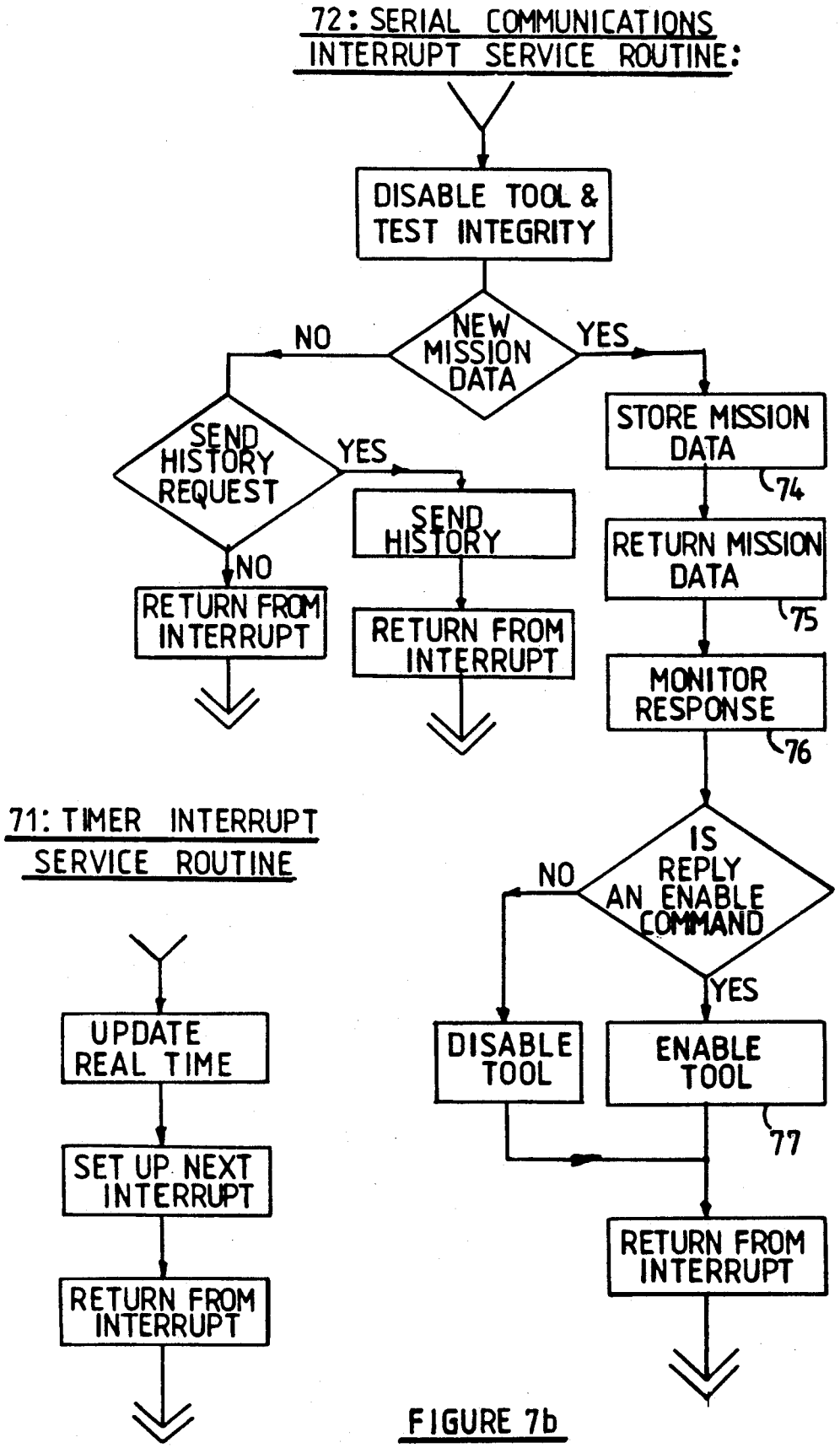

As shown in the flow chart 70 of the main routine in FIG. 7*a*, the first step is a command 78 to identify and to initialize the detonator arrangement. The firing tool is programmed to read an identification code programmed into the detonator arrangement and to proceed with the initialization, only if the tool is pre-programmed to initiate a charge associated with a detonator arrangement with that identification code. After initialization and at 79, test programs resident in controller 27 as well as programs resident in the tool 13 enable the detonator arrangement to perform a functional integrity test and if no faults are detected, then a response signal is sent to the firing tool. The timing of this reply is derived from the detonator arrangement's quartz oscillator 32 and enables the firing tool 13 to measure any difference between the clock pulse repetition rate of secondary clock 31.

In conventional systems a blast sequence may be obtained by selecting for the shots detonators from a range of fixed time delay fuses with delay times staggered in similar steps. Such a system requires a large inventory of detonators.

Lately detonators have been introduced with programmable electronic delays, whereby the inventory is reduced to one type only.

Another way of avoiding the inventory problem is to wire the detonators up in a chain in which between each charge and the next charge in the sequence a fixed delay is wired in and the signal that initiates a detonator also initiates the delay device which produces the initiating signal for the next detonator.

Compared to the programmable detonators used in the conventional firing systems, the programmable detonator arrangements used in the system according to the present invention have to comply with much tougher requirements as far as programmability range and clock pulse rate accuracy goes.

Assume a conventional system with programmable delay fuses catering for a maximum of 100 shots in a blast and a maximum interval of 1 second between any two adjacent shots.

The range of programmable delay available has to be 100 seconds programmable in steps of 1 second. Should it be required that no two adjacent shots shall occur at an interval shorter than $\frac{1}{2} \times 1$ second or 0.5 second, the clock rates of two adjacent detonators in the blast must not deviate by more than 1 pulse in 400 pulses from each other. This type of accuracy is well within the capabilities of the art of integrated circuit manufacture. Particularly if we realize that this art can provide close tracking within a batch even though the accuracy from batch to batch might be less. The true value of the clock rate is relatively unimportant since it does not affect the timing pattern, but only advances or delays the blast time a little.

Accuracies are often expressed in parts per million or p.p.m. Assuming an evacuation time requirement of 900 sec and again 100 shots timed at 1 second intervals with a minimum of 0.5 seconds, the clock accuracy required is 250 p.p.m.

In deep mining, evacuation time of say 10 000 second may be required, requiring a clock pulse rate accuracy of 25 p.p.m. Such accuracies cannot be obtained in a straight forward manner from integrated circuit technology. Moreover, clock pulse generators produce pulse rates that are drifting with time due to ageing and changing environmental influences e.g. temperature. Such drifts are a function of time and over the short delay times covered by conventional programmable detonators may not be of much consequence, but pose a problem in the detonator arrangements according to the invention which have to cover relatively long delays.

In the detonator arrangements according to the invention the effect of inaccuracies of the detonator arrangement clocks is removed by accurately sychronizing the detonator arrangement clocks relative to the master clock. Furthermore, in applications requiring very long delays, the required clock rate stability is obtained by locking it to a resonator with low frequency drift due to ageing and environmental influences. Such a resonator may be a quartz crystal resonator.

Accurate synchronization may be obtained in the following manner:

Assume that the synchronization procedure starts at a time $t_1$, and ends at a time $t_2$. The times $t_1$ and $t_2$ are specified by the secondary clock of the detonator arrangement and fall in the time taken by the charge initiation procedure of the particular detonator arrangement and may be the start time and the end time of the integrity check program described hereabove.

It is not very important how long the interval $t_2-t_1$ is, as long as it contains a known number of clock pulses of the secondary clock and preferably an integer number. The procedure is then as follows: At $t_1$ the master clock reads $m_1$, and the secondary clock $d_1$. At $t_2$ the master clock reads $m_2$ and the secondary clock reads $d_2$. The explosion has to occur at a desired master clock time $m_3$. The equivalent secondary clock time $d_3$ is found from:

$$d_3 = \frac{(d_2 - d_1)}{m_2 - m_1} \times (m_3 - m_1)$$

in which $d_3$, $(d_2-d_1)$ and $(m_3-m_1)$ are integers but $(m_2-m_1)$ contains an unknown fraction of a clock pulse. If the clock rate of the master clock is so high that the interval $m_2-m_1$ contains approximately 1000000 pulses, the maximum one pulse error will represent a timing inaccuracy of only 1 p.p.m.

The timing of interval $d_2-d_1$ is therefore accurate to 1 p.p.m. relative to the master clock, independent of the true value of the secondary clock rate as long as this clock does not drift relative to the master clock.

The provision of a quartz crystal to stabilize the secondary clock against drift would appear a very costly solution, particularly when it is kept in mind that each detonator is destroyed in the explosion. However, most of the cost of quartz crystals is in the grinding of the crystal to a closely toleranced frequency. Since the synchronization procedure allows for a widely toleranced true value of the clock rate, the cost of the crystal can be drastically reduced. Moreover, the extra cost is offset by the elimination of the wire interconnections between the charges, needed in the conventional firing technique.

Figure 8:
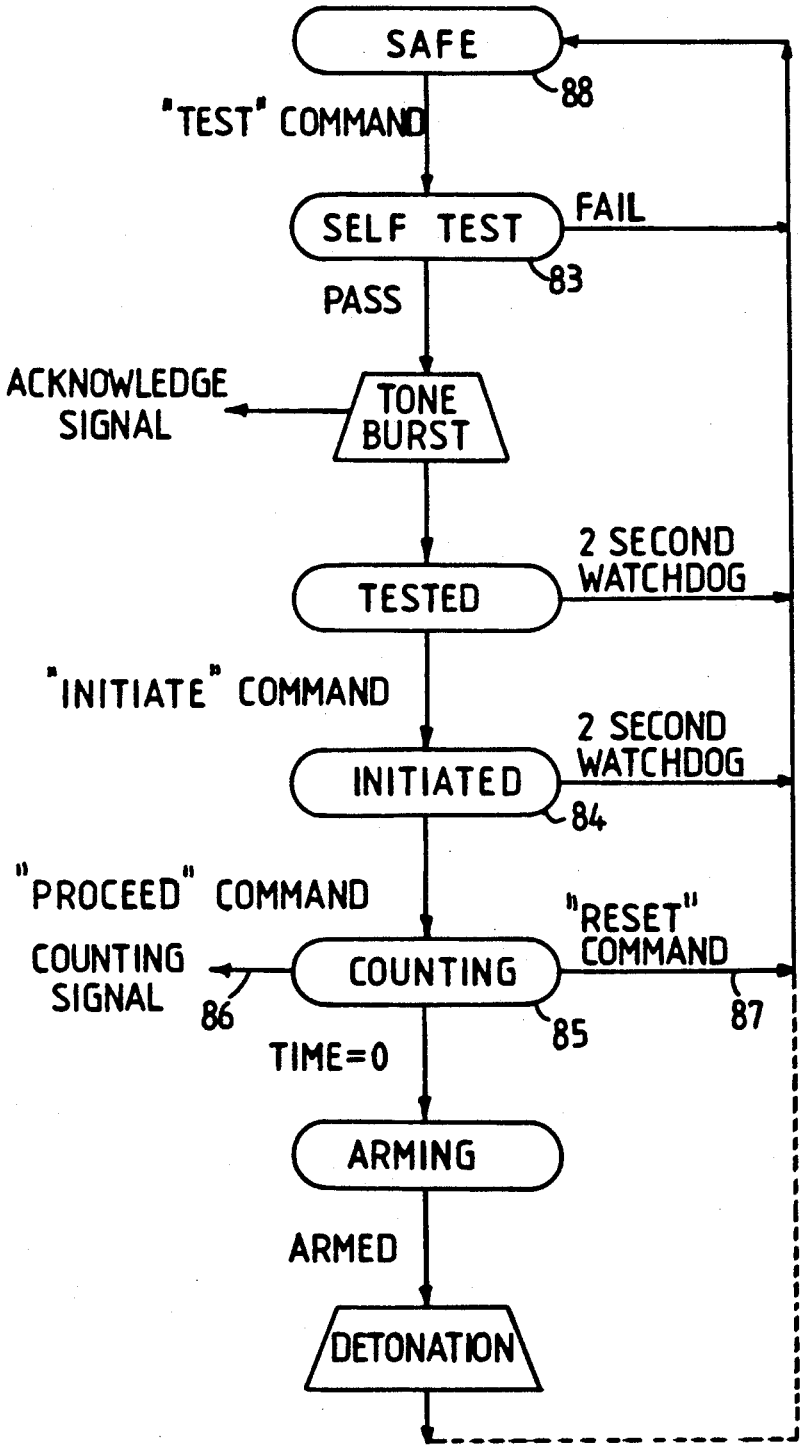
FIG. 8 is a diagram illustrating the various states of the detonator arrangement.

In FIG. 8 there is shown a flow chart of various states of the detonator arrangement. Box 83 represents the integrity test referred to hereabove. After the aforementioned determination of the deviation in clock pulse repetition rates and storage of the delay time data, the detonator arrangement responds by sending a representation of the stored delay time data back to the firing tool. When the firing tool 13 has determined that the delay time data received from the detonator arrangement matches that sent to the detonator arrangement, a proceed command is transmitted to the detonator arrangement. Once the detonator arrangement has traversed through this pre-defined sequence of events correctly, the controller and data processor 27.1 proceed to count out the delay to the detonation moment as shown by block 85. The operator then moves on to the next detonator arrangement to be initiated. During the counting, controller 27 causes arming capacitor 33 to be charged and when the stored delay time has expired according to the secondary clock 31 of the detonator arrangement, controller 27 causes bridge 30 and the associated charge to detonate.

Whilst counting, the detonator arrangement emits a signal as shown at 86 via the data port 26. This enables firing tool 13 to sense if a detonator arrangement to which it is coupled is counting or not. While it is counting, the operator may press the reset input key 23.2 on the firing tool to send a reset command to the detonator arrangement. As is shown at 87, on receipt of a reset command the detonator arrangement stops its count and returns to its initial safe state at 88.

The firing tool 13 maintains in memory a running total of the number of detonator arrangements that have been initiated and reset. It also records if any errors or faults have occurred during a charge initiation mission or operation. This operation history data is captured by the master computer 12 after the operation for inclusion in the system data base as shown in flow charts 70 and 72. After the capturing, the computer 12 resets the tool 13.

During the operation, the firing tool 13 displays messages to the operator on its optical character display 24. These messages include status and fault messages, predetermined desired explosion times, real time, the number of detonators initiated and warning messages such as when the aforementioned time window has run out.

With the method and apparatus according to the invention the firing tool operator can thus initiate a sequence of shots but the actual time of blasting and the sequence thereof are pre-determined by the control station operator and the master computer 12. Though the actual timing of the blast is taken out of the hands of the firing tool operator, he still remains in control of the decision to go ahead with the mission and can stop the mission if required, but he cannot change the timing of the blast or of the individual shots at the blast site as is possible in the known methods.

It will be appreciated that there are many variations in detail possible on the apparatus and method according to the invention without departing from the scope and spirit of the appended claims.

We claim:

1. A method of timing a multi-shot blast using apparatus comprising a transportable electronic firing tool including a master clock, memory circuitry and data processing circuitry; and a plurality of explosive charges, each said charge including an electronic detonator arrangement comprising a secondary clock, memory circuitry and data processing circuitry; the firing tool and each said detonator arrangement being provided with communication means for establishing a data communication path between the firing tool and any one selected detonator arrangement of said detonator arrangements at a time, the method comprising the steps of:

preparing and positioning the charges at a blast site;

loading into and storing in the memory of the firing tool time data representative of a desired charge explosion time for each charge of said plurality of charges;

physically transporting the firing tool to each said charge;

establishing, via the communication means, a data communication path between the firing tool and the detonator arrangement of each said charge individually, one after the other;

while the data communication path is established between the firing tool and a selected detonator arrangement of a selected charge, initiating the selected charge by loading, from the firing tool into the selected detonator arrangement, time data that will cause the selected charge to detonate at the desired charge explosion time associated with the selected charge and storing said time data in the memory circuitry of the selected detonator arrangement; and allowing each of said detonator arrangements to process the time data stored in its memory circuitry and to detonate its associated charge when, according to the detonator arrangement's secondary clock and the time data stored in the detonator arrangement's memory circuitry, the charge must explode.

2. A method as claimed in claim 1 wherein the time data loaded into the firing tool is data representative of the desired charge explosion time, as referenced to the master clock, for each charge of said plurality of charges and wherein, at said charge initiation, data regarding a delay time before explosion is calculated and loaded into the memory circuitry of the selected detonator arrangement.

3. A method as claimed in claim 2 wherein, while the data communication path is established between the firing tool and the selected detonator arrangement, the secondary clock of the selected detonator arrangement is synchronized with the master clock and synchronization data associated with the synchronization is stored in the selected detonator arrangement's memory circuitry; wherein the step of initiating the selected charge comprises using a charge initiation time of the selected charge as measured by the master clock, the desired charge explosion time data for the selected charge and the secondary clock synchronization data to calculate delay time data according to the secondary clock that, when loaded into the selected detonator arrangement, can be used to detonate the selected charge at the charge explosion time desired for said charge.

4. A method as claimed in claim 1 wherein the firing tool master clock is synchronized with real time before the charges are initiated.

5. A method as claimed in claim 1 wherein the firing tool comprises manual data entry means and wherein the step of loading into and storing in firing tool memory data regarding the desired explosion time for each of said charges includes keying the data into the firing tool through said manual data entry means.

6. A method as claimed in claim 1 wherein the method further comprises the steps of establishing a data link between the firing tool and a master computer containing data regarding the desired explosion time for each said charge; synchronizing the master clock with a clock in the master computer; calculating master clock time data equivalent to the desired charge explosion times and loading the calculated master clock time data into the firing tool.

7. A method as claimed in claim 1 wherein the method further comprises the steps of determining the desired charge explosion times, in real time, of the shots in the blast; synchronizing a clock in a master computer with said real time; entering data representative of the desired charge explosion times into the master computer; connecting the firing tool to the master computer; performing an integrity test on the tool; synchronizing the master clock with said real time; and loading master clock equivalent time data of the desired charge explosion times into the firing tool; wherein, while the data communication path is established between the firing tool and the selected detonator arrangement, the secondary clock of the selected detonator arrangement is synchronized with the master clock; and wherein the step of initiating the selected charge comprises the step of using a charge initiating time according to the master clock, the stored desired charge explosion time for the selected charge and data corresponding to said secondary clock synchronization to calculate delay time data according to the secondary clock that, when loaded into the selected detonator arrangement, will cause the selected detonator arrangement to detonate said selected charge at the desired charge explosion time.

8. A method as claimed in claim 1 wherein the method further comprises the step of arming each said detonator arrangement by charging an arming capacitor forming part of each said detonator arrangement between the time when the charge associated with the selected detonator arrangement is initiated and the desired charge explosion time for the selected charge.

9. A method as claimed in claim 1 wherein, while the data communication path is established between the firing tool and the selected detonator arrangement and by means of programs resident in the selected detonator arrangement, integrity tests are performed on the selected detonator arrangement and wherein the tool is adapted to initiate the charge only if the tests are successful.

10. A method as claimed in claim 1 wherein, while the data communication path is established between the firing tool and the selected detonator arrangement, a representation of the time data loaded and stored in the selected detonator arrangement is returned back to the firing tool to ensure that the time data stored in the detonator arrangement is correct.

11. A method as claimed in claim 6:

wherein the step of initiating the selected charge includes gathering, while the data communication path is established between the firing tool and the selected detonator arrangement, operation data regarding the operation of the selected detonator arrangement and storing the operation data in the firing tool; and wherein the method further comprises the steps of:

reading, via said master computer, said operation data stored in the firing tool; and clearing the firing tool.

12. A method as claimed in claim 3 wherein after said synchronization of the secondary clock and the master clock, actual charge detonation time is within 250 p.p.m. of the desired charge explosion time.

13. A method as claimed in claim 1 wherein the secondary clock comprises a resonator for stabilizing a clock pulse repetition rate of the secondary clock.

14. Apparatus for detonating a plurality of explosive charges comprising:

a transportable electronic firing tool comprising data processing and memory circuitry, control circuitry and a master clock, the tool being programmable to receive time data regarding desired times, according to the master clock, at which the charges must explode;

a plurality of electronic detonator arrangements, including one detonator arrangement for each charge of said plurality of charges;

said firing tool and said plurality of electronic detonator arrangements being adapted so that a data communication path may be established between the firing tool and each detonator arrangement of said plurality of electronic detonator arrangements individually one after the other for initiating a charge associated with a selected detonator arrangement of said plurality of electronic detonator arrangements by transferring from the firing tool to the selected detonator arrangement time data regarding the desired time at which the selected detonator arrangement must detonate its associated charge; and each said detonator arrangement comprising data processing and memory circuitry for storing the time data received from the firing tool, control circuitry and a secondary clock; in use, each said detonator arrangement, after said charge initiation, being self-contained, unconnected and adapted to detonate its associated charge when, according to the time data stored and its secondary clock, the charge must explode.

15. Apparatus as claimed in claim 14 wherein the apparatus further comprises a master computer at a control station and wherein the firing tool is connectable to the computer via a communications link.

16. Apparatus as claimed in claim 14 wherein the firing tool is connectable to said selected detonator arrangement via an inductively coupled loop.

17. Apparatus as claimed in claim 14 wherein the firing tool further comprises enabling means for restricting said charge initiation to a predetermined period of time after the tool has been enabled.

18. Apparatus as claimed in claim 14 wherein the firing tool comprises operator controllable reset means for establishing between the firing tool and a previously initiated detonator arrangement of said plurality of detonator arrangements, a data communication path which may be used to reset the previously initiated detonator arrangement to a safe condition.

19. Apparatus as claimed in claim 14 wherein the firing tool further comprises a first resident program; wherein each of said plurality of electronic detonator arrangements comprises a second resident program and wherein the first and second resident programs together enable the firing tool, while the data communication path is established between the firing tool and the selected detonator arrangement, to perform a functional integrity test on the selected detonator arrangement and wherein the firing tool is adapted to initiate the charge associated with the selected detonator arrangement only if the test is successful.

20. Apparatus for detonating a plurality of explosive charges, comprising:

a master computer;

a transportable electronic firing tool comprising data processing and memory circuitry, control circuitry and a master clock, the tool being programmable, via a communications link to the master computer, to receive time data regarding desired times at which the charges must explode;

a plurality of electronic detonator arrangements, including one detonator arrangement for each charge of said plurality of charges;

the firing tool and detonator arrangements being adapted so that a data communication path may be established between the firing tool and each detonator arrangement of said plurality of detonator arrangements individually one after the other for initiating a charge associated with a selected detonator arrangement of said detonator arrangements by transferring from the firing tool to the selected detonator arrangement time data regarding the desired time at which the selected detonator arrangement must detonate its associated charge; and each said detonator arrangement comprising data processing and memory circuitry for storing the time data received from the firing tool, control circuitry and a secondary clock; in use, each said detonator arrangement, after said charge initiation, being self-contained, unconnected and adapted to detonate its associated charge when, according to the time data stored and its secondary clock, the charge must explode;

wherein the firing tool further comprises a housing including a first data interface connectable to the master computer, a second data interface connectable to the selected detonator arrangement, manual data entry means and message display means all internally connected to the data processing circuitry of the firing tool.

21. Apparatus for detonating a plurality of explosive charges, comprising:

a transportable electronic firing tool comprising data processing and memory circuitry, control circuitry and a master clock, the tool being programmable to receive, for each of the plurality of charges, charge explosion time data corresponding to a desired time, according to the master clock, at which the charge must explode;

a plurality of electronic detonator arrangements, including one detonator arrangement for each charge of said plurality of charges;

the firing tool and detonator arrangements being adapted so that a data communication path may be established between the firing tool and each detonator arrangement of said plurality of detonator arrangements individually one after the other for initiating a charge associated with a selected detonator arrangement of said detonator arrangements by transferring from the firing tool to the selected detonator arrangement the charge explosion time data associated with that charge; and each said detonator arrangement comprising data processing and memory circuitry for storing the charge explosion time data received from the firing tool, control circuitry and a secondary clock; in use, each said detonator arrangement, after said charge initiation, being self-contained, unconnected and adapted to detonate its associated charge when, according to the time data stored and its secondary clock, the charge must explode;

wherein the firing tool further comprises enabling means for restricting said charge initiation to a predetermined period of time after the tool has been enabled and wherein the tool comprises a warning indicator which is actuable when said predetermined period of time has expired.

22. Apparatus for detonating a plurality of explosive charges, comprising:

a transportable electronic firing tool comprising data processing and memory circuitry, control circuitry and a master clock, the tool being programmable to receive time data regarding desired times at which the charges must explode;

a plurality of electronic detonator arrangements, including one detonator arrangement for each charge of said plurality of charges;

the firing tool and detonator arrangements being adapted so that a data communication path may be established between the firing tool and each detonator arrangement of said plurality of detonator arrangements individually one after the other for initiating a charge associated with a selected detonator arrangement of said detonator arrangements by transferring from the firing tool to the selected detonator arrangement time data regarding the desired time at which the selected detonator arrangement must detonate its associated charge; and each said detonator arrangement comprising detonator data processing circuitry, detonator memory circuitry capable of storing the time data received from the firing tool, detonator control circuitry and a secondary clock; in use, each said detonator arrangement, after said charge initiation, being self-contained, unconnected and adapted to detonate its associated charge when, according to the time data stored and its secondary clock, the charge must explode;

wherein each of said detonator arrangements comprises a housing including a data interface connectable to the firing tool, an output stage and a battery all connected to the detonator data processing circuitry and the detonator control circuitry, the output stage comprising an arming capacitor and the detonator data processing circuitry and the detonator control circuitry being adapted to generate signals to charge the capacitor after said charge initiation and to cause the capacitor to discharge into a detonating device when the detonator arrangement must detonate the explosive charge associated therewith.

23. Apparatus as claimed in claim 22 wherein the detonating device comprises a semi-conductor bridge.

24. Apparatus as claimed in claim 22 wherein a characteristic code is pre-programmed into each of said plurality of electronic detonator arrangements, and wherein the firing tool is adapted to read the characteristic code of the selected detonator arrangement and to initiate a charge associated with the selected detonator arrangement only if the code corresponds to a code pre-programmed into the firing tool.

* * * * *

UNITED STATES PATENT AND TRADEMARK OFFICE

CERTIFICATE OF CORRECTION

PATENT NO. : 5,214,236

DATED : 25 May 1993

INVENTOR(S) : Murphy et al.

It is certified that error appears in the above-identified patent and that said Letters Patent is hereby corrected as shown below:

In column 4, line 7, delete "shorts" and insert --shots--.

In column 5, line 1, delete "initiated" and insert --initiate--.

In column 6, line 31, delete "and 3600 seconds and" and insert -- 900 seconds and 3600 seconds.--

In column 7, line 65, insert --The-- after the numeral "14."

In column 10, line 33, delete "second," and insert --seconds,--.

In column 11, line 32, delete "$d_2$-$d_1$" and insert --$d_3$-$d_1$--.

Signed and Sealed this

Twelfth Day of April, 1994

Bruce Lehman

*Attest:*

BRUCE LEHMAN

*Commissioner of Patents and Trademarks*

*Attesting Officer*